US010151173B2

(12) United States Patent
Horwell

(10) Patent No.: US 10,151,173 B2
(45) Date of Patent: Dec. 11, 2018

(54) FLOAT VALVE HOLD OPEN DEVICES AND METHODS THEREFOR

(71) Applicant: SWITCHFLOAT HOLDINGS LIMITED, Inglewood (NZ)

(72) Inventor: Mark Graham Horwell, Urenui (NZ)

(73) Assignee: Switchfloat Holdings Limited, Inglewood (NZ)

( * ) Notice: Subject to any disclaimer, the term of this patent is extended or adjusted under 35 U.S.C. 154(b) by 629 days.

(21) Appl. No.: 14/427,175

(22) PCT Filed: Sep. 4, 2013

(86) PCT No.: PCT/NZ2013/000160
§ 371 (c)(1),
(2) Date: Mar. 10, 2015

(87) PCT Pub. No.: WO2014/042541
PCT Pub. Date: Mar. 20, 2014

(65) Prior Publication Data

US 2015/0240596 A1 Aug. 27, 2015

(30) Foreign Application Priority Data

Sep. 13, 2012 (NZ) ..... 602394

(51) Int. Cl.
*E21B 34/12* (2006.01)
*E21B 34/10* (2006.01)
(Continued)

(52) U.S. Cl.
CPC ..... *E21B 34/12* (2013.01); *E21B 34/102* (2013.01); *E21B 34/16* (2013.01); *E21B 2034/005* (2013.01)

(58) Field of Classification Search
CPC ..... E21B 34/00; E21B 34/12; E21B 34/14; E21B 34/16; E21B 34/102; E21B 2034/005; E21B 2034/007
See application file for complete search history.

(56) References Cited

U.S. PATENT DOCUMENTS 2,162,578 A 6/1939 Hacker
2,447,842 A 2/1948 Cameron
(Continued)

OTHER PUBLICATIONS

International Search Report for International Application No. PCT/NZ2013/000160 dated Nov. 13, 2013 (5 pages).
(Continued)

*Primary Examiner* — Brad Harcourt
*Assistant Examiner* — David Carroll
(74) *Attorney, Agent, or Firm* — Merchant & Gould P.C.

(57) ABSTRACT

A float valve for positioning downhole within a wellbore as part of a drill string. The float valve has an outer hollow housing for connection to and location between an upper and lower sections of the drill string. A flap valve is located at least in part within the outer hollow housing to allow or disallow flow of fluid and/or objects through the outer hollow housing via the float valve. A sliding sleeve is located at least in part within the outer hollow housing, to translate at least in part within the outer hollow housing, such that in a first position the sliding sleeve is clear of the flap valve, and in a second position the sliding sleeve retains the flap valve open to allow the flow therethrough. The sliding sleeve can be remotely actuated between the first and second positions to allow the flap valve to close or to retain the flap valve open, such that when the flap valve is retained open objects and or fluid can pass from the upper section to the lower section and vice versa, through the outer hollow housing.

19 Claims, 6 Drawing Sheets

(51) Int. Cl.
*E21B 34/16* (2006.01)
*E21B 34/00* (2006.01)

(56) References Cited

U.S. PATENT DOCUMENTS

| | | | | | |
|---|---|---|---|---|---|
| 3,066,693 | A | * | 12/1962 | Taylor, Jr. | E21B 21/10 137/454.2 |
| 3,071,151 | A | | 1/1963 | Sizer | |
| 3,275,080 | A | | 9/1966 | Nelson | |
| 3,318,387 | A | | 5/1967 | Jones | |
| 4,427,071 | A | | 1/1984 | Carmody | |
| 4,436,152 | A | | 3/1984 | Fisher, Jr. et al. | |
| 4,457,376 | A | | 7/1984 | Carmody | |
| 5,479,989 | A | * | 1/1996 | Shy | E21B 34/06 166/332.4 |
| 5,823,265 | A | * | 10/1998 | Crow | E21B 34/06 166/110 |
| 6,575,249 | B2 | | 7/2003 | Deaton | |
| 7,360,600 | B2 | | 4/2008 | MacDougall | |
| 7,677,304 | B1 | | 3/2010 | Smith | |
| 7,712,538 | B2 | | 5/2010 | Fay | |
| 8,104,505 | B2 | | 1/2012 | O'Brien | |
| 2011/0048742 | A1 | * | 3/2011 | Smith | E21B 34/14 166/386 |
| 2013/0043042 | A1 | | 2/2013 | Flores | |

OTHER PUBLICATIONS

International Preliminary Report on Patentability for International Application No. PCT/NZ2013/000160 dated Mar. 17, 2015 (8 pages).

* cited by examiner

FLOAT VALVE HOLD OPEN DEVICES AND METHODS THEREFOR

This application is a National Stage Application of PCT/NZ2013/000160, filed 4 Sep. 2013, which claims benefit of Serial No. 602394, filed 13 Sep. 2012 in New Zealand and which applications are incorporated herein by reference. To the extent appropriate, a claim of priority is made to each of the above disclosed applications.

FIELD OF THE INVENTION

This invention relates to the drilling operation of boreholes for hydrocarbon, water and geothermal reserves.

In particular the invention is a device that can hold multiple float valves open in a drill string.

BACKGROUND OF THE INVENTION

When drilling boreholes as part of drilling operations (as distinct from well completion operations) it is common to use float valves in the drill string. Float valves allow flow in one direction but not the other.

Float valves allow fluid to be pumped down the drill string. When fluid flow down the drill string stops, the float valve closes. A higher pressure below the float valve than that above the float valve holds the valve closed. Fluid is therefore prevented from migrating back up the drill string. This allows for operations on the drill string at surface, such as addition or removal of drill pipe. In a drilling operation a typical operation cost is NZ$100,000 per day. Therefore any time spent with the rig idle, or not progressing with drilling the well is costly.

However there are often operations that are necessary on a rig that may lead to the rig being idle, or at least drilling not progressing. In order for a drill pipe connection to be disconnected at surface the pressure in the drill string must first be bled off to atmospheric pressure. By including multiple float valves in the drill string a smaller volume is required to be bled off, hence reducing the time required to perform this process For various reasons it may be necessary to convey objects within the drill string by slickline, wireline or other methods, for example survey equipment. If float valves are present in a drill string then they present an obstruction or hindrance to the equipment being moved down and up the drill string.

Currently, when it is necessary to convey an object down the drill string, float valves are required to be removed from the drill string. This involves removing the drill string from the borehole, adding time and cost to operations. This also adds cost due to a reduction in the service life of the drill string components. To get an indication of the costs associated with removing the float valves to conduct for example a survey and putting them back in again we examine typical procedure for a geothermal well. Surveying must often occur at regular distances as the drill string progresses down a well, for example a survey may be made for every 300 m increase in depth. The casing shoe depth is 1500 m, total depth is 2800 m, the survey frequency is 300 m, the drill pipe length is 13.4 m, and the rig pipe tripping speed is 180 m/hr.

Where drilling requires slickline directional surveys or Pa logging runs inside drillpipe, the float valves must be removed from and later reinstalled into the drill string. To do this for a directional survey, the drilling bit is tripped back up to inside the casing shoe removing float valve subs, a survey tool is conveyed on slickline to a sub in the BHA, the drill string is tripped to bottom then back up into the casing shoe, the survey tool is retrieved on slickline then the drill string is tripped back to bottom to continue drilling, inserting float valves on the way. This is tripping four times the distance from the survey depth to the casing shoe. So if we consider a well that is surveyed at 1800 m, 2100 m, 2400 m and 2800 m the total distance tripped due to surveys is:

$$4\times300\text{ m}+4\times600\text{ m}+4\times900\text{ m}+4\times1300\text{ m}=12400\text{ m}$$

$$12400/180\text{ m per hour}=68\text{ hours or }2.9\text{ days per well}$$

With string float valves installed typically at 150 m intervals, string float valves would be removed or installed (4+8+12+16=40) times. With each change taking 5 minutes, that incurs another 3 hours of rig time.

Assuming 6 wells drilled per year and $100,000 per day rig cost, this is a saving of 6×3×100000=$1.8 M/year By reducing the time and cost currently associated with surveying, additional surveys may be carried out as/if required.

It can be seen therefore that cost will quickly mount for even just one rig, let alone a fleet of them in operation.

A risk associated with drilling unstable formations is potential collapse of the well bore about the drill string. In some circumstances this can result in the drill string being stuck in hole. If this occurs then there is the additional cost and time of trying to free the drill string. It can be necessary to convey tools and explosive charges down the drill string to aid in recovery. In these circumstances float valves can hinder down-hole operations and recovery. If recovery is unsuccessful then there is the cost of the lost tooling down the well hole.

One other partial solution currently used is to convey a 'hold open device' down the drill pipe that sits in the very top float valve. This allows access to the drill pipe below the first float valve, but is not able to hold open any further float valves in the drill string.

In this specification where reference has been made to patent specifications, other external documents, or other sources of information, this is generally for the purpose of providing a context for discussing the features of the invention. Unless specifically stated otherwise, reference to such external documents is not to be construed as an admission that such documents, or such sources of information, in any jurisdiction, are prior art, or form part of the common general knowledge in the art.

It is an object of the present invention to provide an improved float valve hold open device or to overcome the above shortcomings or address the above desiderata, or to at least provide the public with a useful choice.

BRIEF DESCRIPTION OF THE INVENTION

In a first aspect the present invention consists in a float valve adapted for positioning downhole within a wellbore as part of a drill string, said float valve comprising or including:

- an outer hollow housing for connection to and location between an upper and lower sections of said drill string,
- a flap valve located at least in part within said outer hollow housing to allow or disallow flow of fluid and/or objects through said outer hollow housing via said float valve,
- a sliding sleeve at least in part within said outer hollow housing, to translate at least in part within said outer hollow housing, such that in a first position said sliding sleeve is clear of said flap valve, and in a second position said sliding sleeve retains said flap valve open to allow said flow therethrough;

wherein said sliding sleeve can be remotely actuated between said first and second positions to allow said flap valve to close or to retain said flap valve open, such that when said flap valve is retained open objects and or fluid can pass from said upper section to said lower section and vice versa, through said outer hollow housing.

Preferably said outer hollow housing forms a sub as part of said drill string.

Preferably said outer hollow housing has an upper portion releasably connected to a lower portion, which together forms said sub.

Preferably said outer hollow housing is dimensioned to fit down said wellbore.

Preferably said flap valve when closed allows flow down said drill string but not up.

Preferably said flap valve is contained within a valve body which can be installed and removed when said outer hollow housing is assembled or disassembled.

Preferably said sliding sleeve has a tool engaging profile for said remote actuation by a tool.

Preferably said tool engaging profile is on an internal surface of said sliding sleeve.

Preferably said tool engaging profile is directionally specific so as to only engage with said tool at least when said tool is moving in the correct direction to engage therewith.

Preferably said tool has an engaging orientation and a non-engaging orientation, and must be in said engaging orientation and travelling in said correct direction to engage with said tool engaging profile and remotely actuate said sliding sleeve.

Preferably there is a said tool engaging profile at, or toward, each end of said sliding sleeve, each said engaging profile oriented in the direction opposite to that of the other.

Preferably said tool is a shifting tool and said shifting tool is dropped, pumped, tractored or conveyed by slickline or wireline or by other means along said drill string.

Preferably there are least two tools, a first and a second said tool, each after the other, to achieve said remote actuation, said second and any subsequent tools present to back up said first tool.

Preferably when moving said tool down said drill string to actuate said sliding sleeve to retain said flap valve open, said first tool, said second tool and any said subsequent tools are in the same engaging orientation and the second tool and any said subsequent tools will engage said sliding sleeve and shift it if said first tool fails to actuate.

Preferably said tool is moved down from an upper level to a desired lower level of said drill string to actuate sequentially a series of said sliding sleeves from said second position into said first position down said drill string to said desired lower level.

Preferably when moving said tool up said drill string to actuate said sliding sleeve to said first position clear of said flap valve to allow to close, said second tool is in the engaging orientation to actuate said sliding sleeve to said first position and said first tool is in the opposite orientation such that it cannot fall past said flap valve once said sliding sleeve is clear of said flap valve.

Preferably said tool is moved up from at or toward said desired lower level of said drill string to actuate sequentially a series of said sliding sleeves from said second position into said first position up said drill string to a desired upper level.

Preferably said sliding sleeve has at least one locking portion that engages with an interior of said outer hollow housing to provide a friction against movement of said sliding sleeve.

Preferably said at least one locking portion is provided by any one or more of, at least one elastomeric material, a locking collet means.

Preferably said interior has detents to selectively receive said at least one locking portion to prevent movement of said sliding sleeve save for when actuated.

Preferably said sliding sleeve has said at least one locking portion, toward an upper end of said sliding sleeve.

In another aspect the present invention consists in a method of use of a float valve in a drill string comprising or including the steps of:

controlling a sliding sleeve contained within a sub intermediate of lengths of said drill string, to translate within said sub, such that in a first position said sliding sleeve is clear of a flap of said float valve within said sub, and in a second position said sliding sleeve retains open said flap open to allow fluid and object communication therethrough;

wherein remote actuation of said sliding sleeve allows control of said float valve to allow or deny flow of fluid and/or objects through said float valve and thence up or down said drill string.

Preferably there are multiple said float valves along said drill string.

Preferably said multiple said float valves can be sequentially retained open down to a desired level of said drill string.

Preferably said multiple said float valves are retained open down said drill string so operations can be achieved to any point down to said desired level.

Preferably after said down well operations are complete at least some of said multiple said float valves can sequentially then be allowed to close from at or near said desired level up said drill string.

Preferably said float valve is contained within a valve body which can be installed and removed when said sub is assembled or disassembled.

Preferably said sliding sleeve has a tool engaging profile for said remote operation by a tool.

Preferably said tool engaging profile is on an internal surface of said sliding sleeve.

Preferably said tool engaging profile is directionally specific so as to only engage with said tool at least when said tool is moving in the correct direction to engage therewith.

Preferably said tool also has an engaging orientation and a non-engaging orientation, and must be in said engaging orientation and travelling in said correct direction to engage with said tool engaging profile and remotely actuate said sliding sleeve.

Preferably there is a said tool engaging profile at, or toward, each end of said sliding sleeve, each said engaging profile oriented in the direction opposite to that of the other.

Preferably said tool is a shifting tool and said shifting tool is dropped, pumped, tractored or conveyed by slickline or wireline or by other means along said drill string.

Preferably there are least two tools, a first and a second said tool, each after the other, to achieve said remote actuation, said second and any subsequent tools present to back up said first tool.

Preferably when moving said tool down said drill string to actuate said sliding sleeve to retain said flap valve open, said first tool, said second tool and any said subsequent tools are in the same engaging orientation and the second tool and any said subsequent tools will engage said sliding sleeve and shift it if said first tool fails to fully actuate said sleeve from said first position to said second position.

Preferably said tool is moved down from an upper level to a desired lower level of said drill string to actuate sequentially a series of said sliding sleeves of float valves from said second position into said first position down said drill string to said desired lower level.

Preferably when moving said tool up said drill string to actuate said sliding sleeve to said first position clear of said flap valve to allow to close, said second tool is in the engaging orientation to actuate said sliding sleeve to said first position and said first tool is in the opposite orientation such that it cannot fall through said sub.

Preferably said tool is moved up from at or toward said desired lower level of said drill string to actuate sequentially a series of said sliding sleeves of float valves from said second position into said first position up said drill string to a desired upper level.

Preferably said sliding sleeve has a locking portion that engages with an interior detent of said sub to provide a friction against movement of said sliding sleeve.

In yet another aspect the present invention consists in actuable flap valve for positioning downhole within a wellbore as part of a drill string, said actuable flap valve comprising or including,

- a flap valve for location within a sub, said flap valve able to open and allow movement through said sub, or close to seal and prevent movement through said sub,
- a sliding sleeve for location within said sub, said sliding sleeve to slide relative said flap valve between a first position where said sliding sleeve is clear of said flap valve allowing said flap valve to close, and in a second position said sliding sleeve retains said flap valve open to allow said movement therethrough;

wherein said sliding sleeve is adapted to be remotely actuated between said first and second positions, such that when said flap valve is retained open objects can be passed past said flap valve and move up and down said drill string.

In still yet another aspect the present invention consists in a drill string with a float valve, said float valve comprising or including:

- at least one sub for location between lengths of a drill string, an upper portion in selective fluid communication with a lower portion via a hollow interior thereof;
- a float valve located at least in part within said sub to allow or disallow flow of fluid and/or objects through said hollow interior via said float valve;
- a sliding sleeve at least in part within said sub, to translate at least in part within said sub, such that in a first position said sliding sleeve is clear of said float valve, and in a second position said sliding sleeve retains said float valve open to allow flow therethrough;

wherein remote operation of said sliding sleeve allows control of said float valve to allow or deny flow of fluid and/or objects through said hollow interior and thence up or down said drill string.

Preferably there is a plurality of said float valves in said drill string.

Preferably said sliding sleeve is actuated by a shifting tool that is dropped, pumped or conveyed by slickline or wireline or by other means along said drill string.

Preferably said plurality of float valves can be sequentially opened from above down to a desired lower level, by said shifting tool shifting said sliding sleeves in each said float valve to said second position, and then sequentially closed from below from at or near said desired lower level by shifting said sliding sleeves in each said float valves to said first position.

In still yet another aspect the present invention consists in a kit of parts for a float valve comprising:

- a flap valve for location within a sub, said flap valve able to open and allow movement through said sub, or close to seal and prevent movement through said sub,
- a sliding sleeve for location within said sub and above said float valve, said sliding sleeve when assembled to slide relative said float valve between a first position where said sliding sleeve is clear of said flap valve allowing said flap valve to close, and in a second position said sliding sleeve retains said flap valve open to allow said movement therethrough;

wherein when said float valve and sub are assembled as part of a drill string said sliding sleeve can be remotely actuated between said first and second positions, such that when said flap valve is retained open objects can be passed past said flap valve and move up and down said drill string.

Preferably said kit includes said sub.

Preferably said sub can be disassembled into an upper portion and a lower portion to access a hollow of said sub to allow assembly and disassembly of said flap valve and said sliding sleeve within said hollow.

In another aspect the present invention consists in a float valve as herein described with reference to any one or more of the accompanying drawings.

In another aspect the present invention consists in a method of use of a float valve as herein described with reference to any one or more of the accompanying drawings.

In another aspect the present invention consists in an actuable flap valve as herein described with reference to any one or more of the accompanying drawings.

In another aspect the present invention consists in a drill string as herein described with reference to any one or more of the accompanying drawings.

In another aspect the present invention consists in a kit of parts for a float valve as herein described with reference to any one or more of the accompanying drawing.

As used herein the term "and/or" means "and" or "or", or both.

As used herein "(s)" following a noun means the plural and/or singular forms of the noun.

The term "comprising" as used in this specification means "consisting at least in part of". When interpreting statements in this specification which include that term, the features, prefaced by that term in each statement, all need to be present, but other features can also be present. Related terms such as "comprise" and "comprised" are to be interpreted in the same manner.

It is intended that reference to a range of numbers disclosed herein (for example, 1 to 10) also incorporates reference to all rational numbers within that range (for example, 1, 1.1, 2, 3, 3.9, 4, 5, 6, 6.5, 7, 8, 9 and 10) and also any range of rational numbers within that range (for example, 2 to 8, 1.5 to 5.5 and 3.1 to 4.7).

The entire disclosures of all applications, patents and publications, cited above and below, if any, are hereby incorporated by reference.

To those skilled in the art to which the invention relates, many changes in construction and widely differing embodiments and application of the invention will suggest themselves without departing from the scope of the invention as defined in the appended claims. The disclosures and the descriptions herein are purely illustrative and are not intended to be in any sense limiting.

Other aspects of the invention may become apparent from the following description which is given by way of example only and with reference to the accompanying drawings.

BRIEF DESCRIPTION OF THE DRAWINGS

Preferred forms of the present invention will now be described with reference to the accompanying drawings in which.

DETAILED DESCRIPTION OF THE INVENTION

Figure 5:
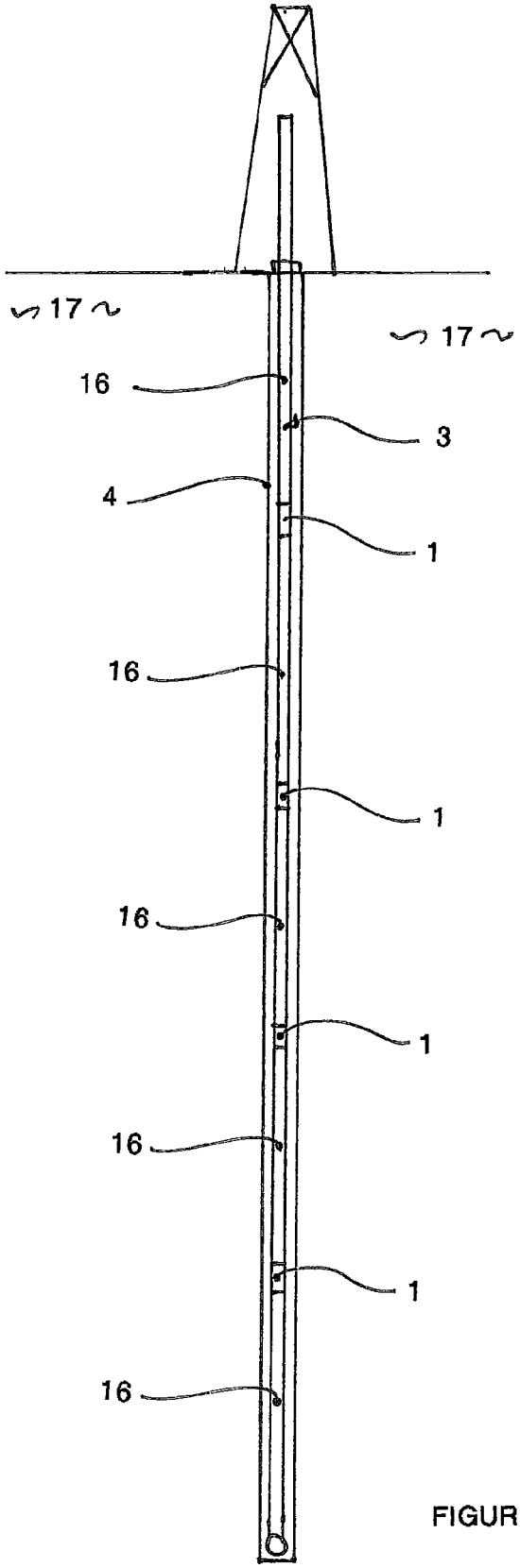
FIG. 5 shows a schematic cross-section of a wellbore and drill string.

Preferred embodiments will now be described with reference to FIGS. 1 through 6. This invention allows for multiple float valves 1 to be held open in a drill string 3 which is down a wellbore or borehole 4 in the earth 17 as shown in FIG. 5. This is achieved without removing the drill string 3 from a borehole 4. Objects, such as, but not limited to, survey tools, maintenance tools, or otherwise may then be conveyed within the drill string 3 without hindrance. The float valves 1 may then be returned to their standard mode of operation, also without removal of the drill string 3 from the borehole 4.

The invention allows holding open one, or multiple, float valves 1 in a drill string 3 without the necessity to remove the drill string from the borehole. The current practice for gaining access below more than one float valve 1 down a drill string 3 is to raise the drill string 3 up and remove each float valve 1 down to the level it is desired to have the float valves opened to, for example to a level where surveying must take place. The drill string 3 is then reinstalled in the wellbore 4 without the float valves 1 in place. The desired operation (for example surveying) is then done. The process is then reversed to re-install the float valves 1 and return them to a state where the float valve 1 operates in its normal mode (that is closed on back pressure).

This invention allows the multiple float valves 1 down the drill string to be opened sequentially down the drill string 3, held open and then allows for closing them in sequence again back up the drill string 3. The float valve 1 in its open position allows fluid and objects to pass through or by the open float valve 1 within the drill string 3 without hindrance. The float valves 1 can then be allowed to close again and the float valve 1 returns to its normal mode of operation, allowing flow in one direction (normally down) but not the other.

A preferred form of the present invention is shown in FIGS. 1 through 4. An outer housing is used, normally referred to as a sub 18, normally consisting of two pieces as an upper portion, housing or upper sub 18A and a lower portion, housing or lower sub 18B, which together form the sub 18 assembly. The upper sub 18A has a join 19 to the lower sub 18B using a standard industry connection, such as a threaded connection 15 (in some instances this is a tapered threaded connection) though other known connecting methods can be used. There is also a connection at the top and bottom of the assembled sub 18 to allow it to be connected as part of the drill string to thus add the float valve 1 functionality in. This connection may be of any standard industry type, and in the preferred form shown it is a tapered thread—female 15A at the top, and male 15B at the bottom. Additional material is included at threaded connections 15A, 15B at the upper and lower ends of the sub 18 to allow for thread redressing as required.

Sufficient length is provided on the outer surface 20 of both the upper 18A and lower 18B sub to allow for clamping and tightening/loosening of threaded connections. This can occur as part of the assembly and disassembly of the sub as needed to access the float valve gate/flapper valve 5, and the sliding sleeve 2 which is discussed shortly.

The sub 18 has an outer surface area and length such that once the upper 18A and lower 18B are assembled the sub 18 can be clamped for tightening/loosening as part of its assembly and disassembly into and out of the drill string 3. These outer surfaces 18 are the same dimension as the drill pipe the invention is used in conjunction with. This allows operators to tighten or loosen connections using existing rig tooling. The sub 18 is generally made from steel such as AISI 4145 or AISI 4140.

Figure 1A:
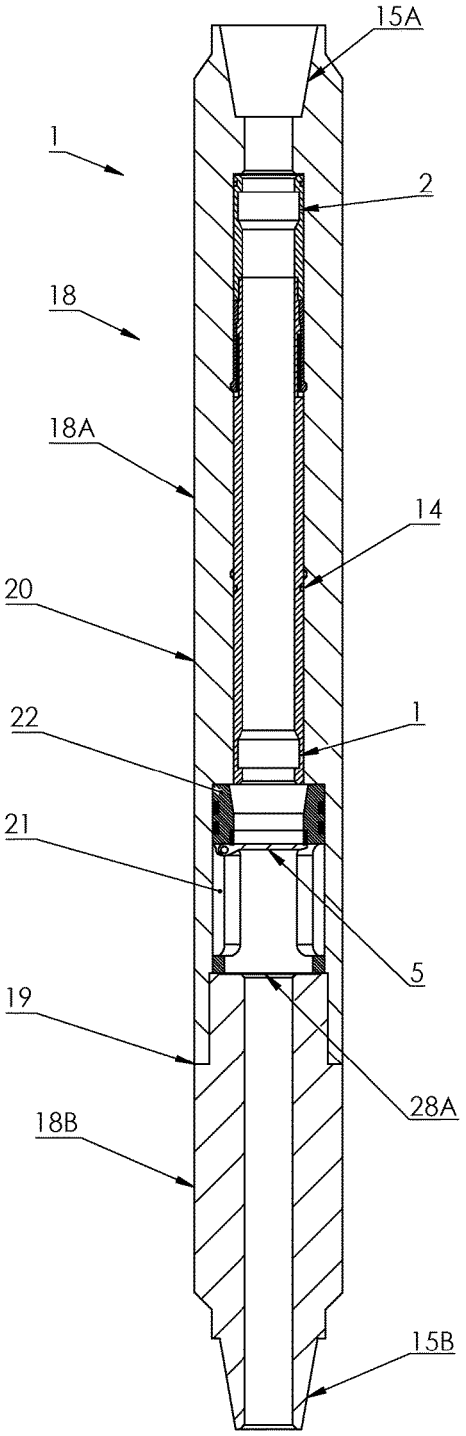
FIG. 1A shows a sectioned view of an embodiment of the invention with the sleeve retracted and the float valve in its normal mode of operation.

The sub 18 has a hollow interior 21 as shown in FIGS. 1A and B running from end to end between connections 15A and 15B. This allows movement of fluid and or objects through the sub 18 when certain conditions are met.

Figure 1B:
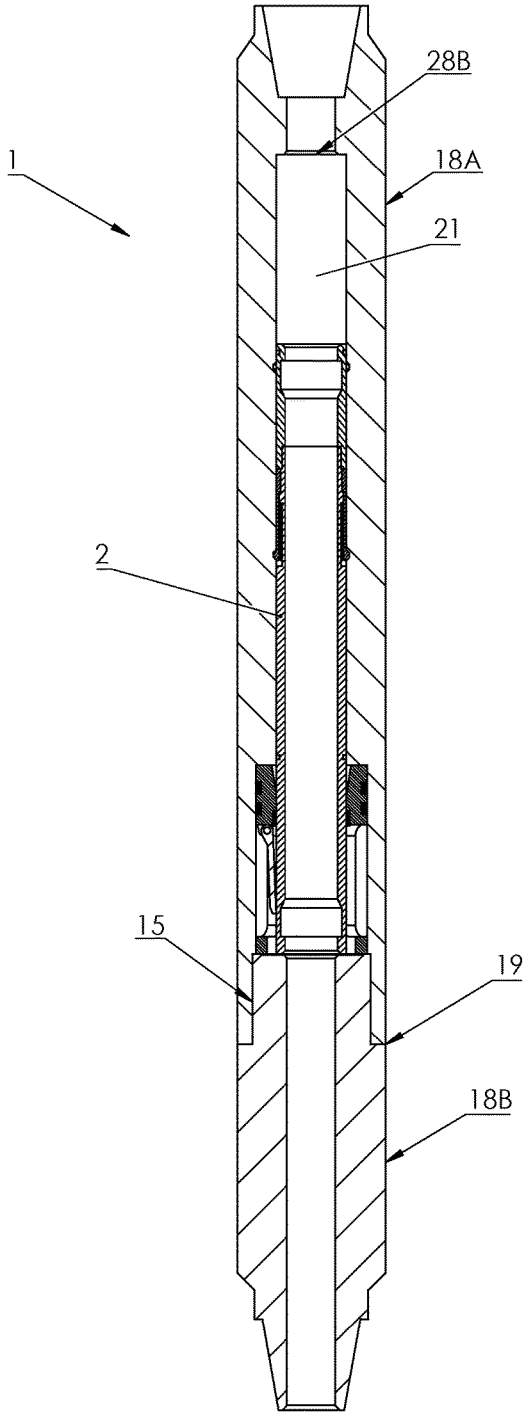
FIG. 1B shows a sectioned view of an embodiment of the invention with the float valve held open.

Within the hollow interior, generally within an enlarged part of the interior, of the sub 18 is housed a flap valve or float valve gate 5 as shown in FIGS. 1A and B. A flap valve 5 is also referred to as a flapper valve in the industry. In the preferred form the flap valve 5 is biased upwardly to close as shown in FIG. 1A, such that when closed, pressure from below, in direction A, up the sub 18, will hold the flap valve closed and thus close or block the valve. A pressure above exceeding pressure from below the flap valve 5 will open the flap valve 5. The flap valve 5 is pivoted relative the sub such that it can open and close the interior 21 of the sub 18. Typically the flap valve 5 is held in a valve body 21, in other embodiments it may be pivoted directly from the interior of the sub 18. The valve body is in its simplest form a hollow cylinder within which the flap valve 5 is pivoted. When open, as shown in FIG. 1B, the flap valve 5 provides a largely unimpeded passage through the sub 18.

The valve body has the advantage that it can be installed or removed from the sub to change the valve size, for maintenance or repair or replacement of the valve 5.

Figure 2A:
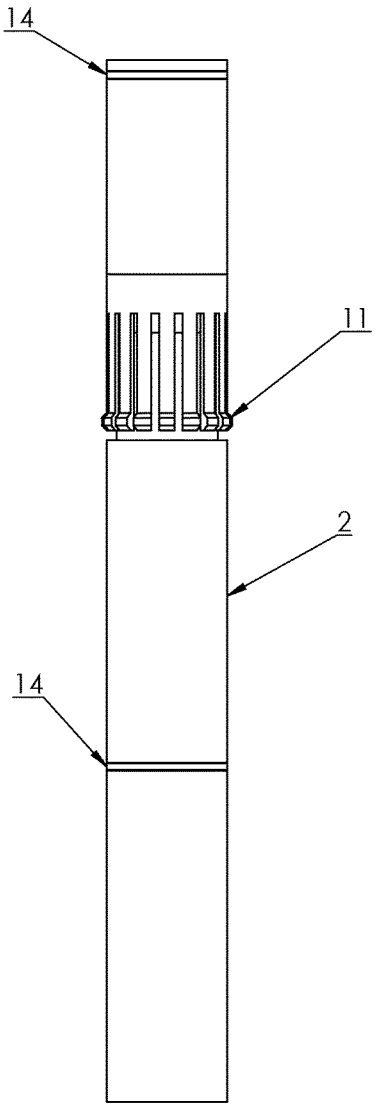
FIG. 2A shows one embodiment of the sliding sleeve, when removed from the float valve sub.
Figure 2B:
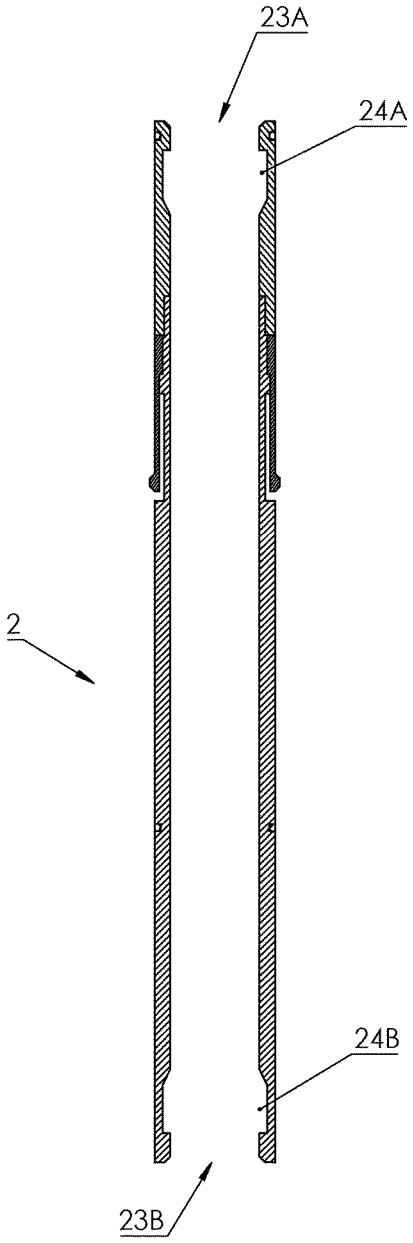
FIG. 2B shows a cross-section of one embodiment of the sliding sleeve, when removed from the float valve sub.
Figure 3A:
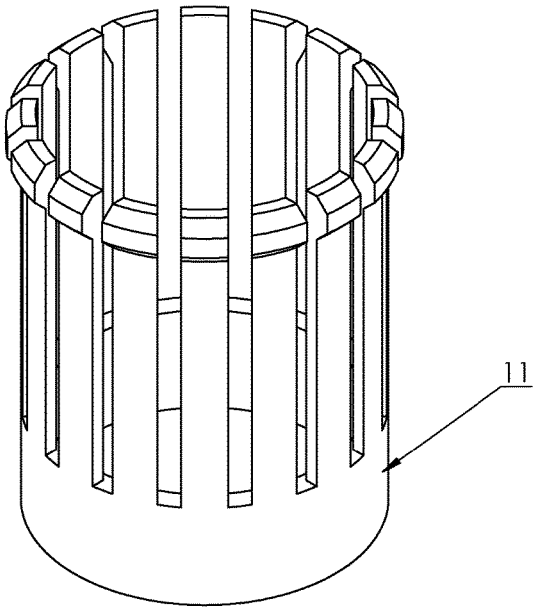
FIG. 3A shows an isometric view of the locking collet when removed from the sliding sleeve.
Figure 3B:
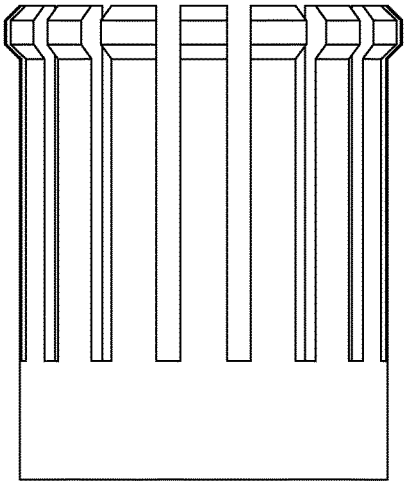
FIG. 3B shows a front view of the locking collet.
Figure 3C:
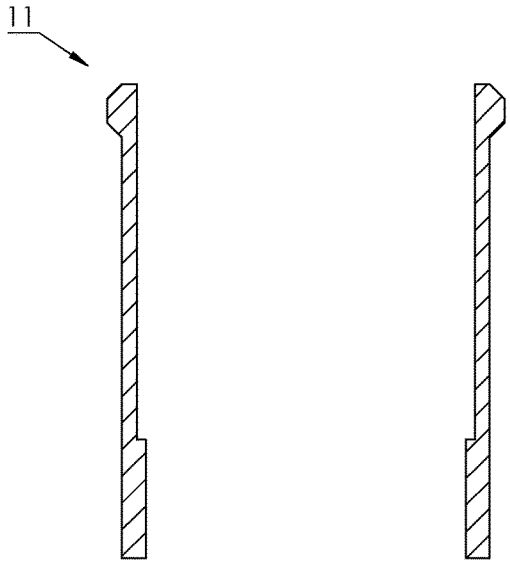
FIG. 3C shows a cross section of the locking collet.
Figure 4:
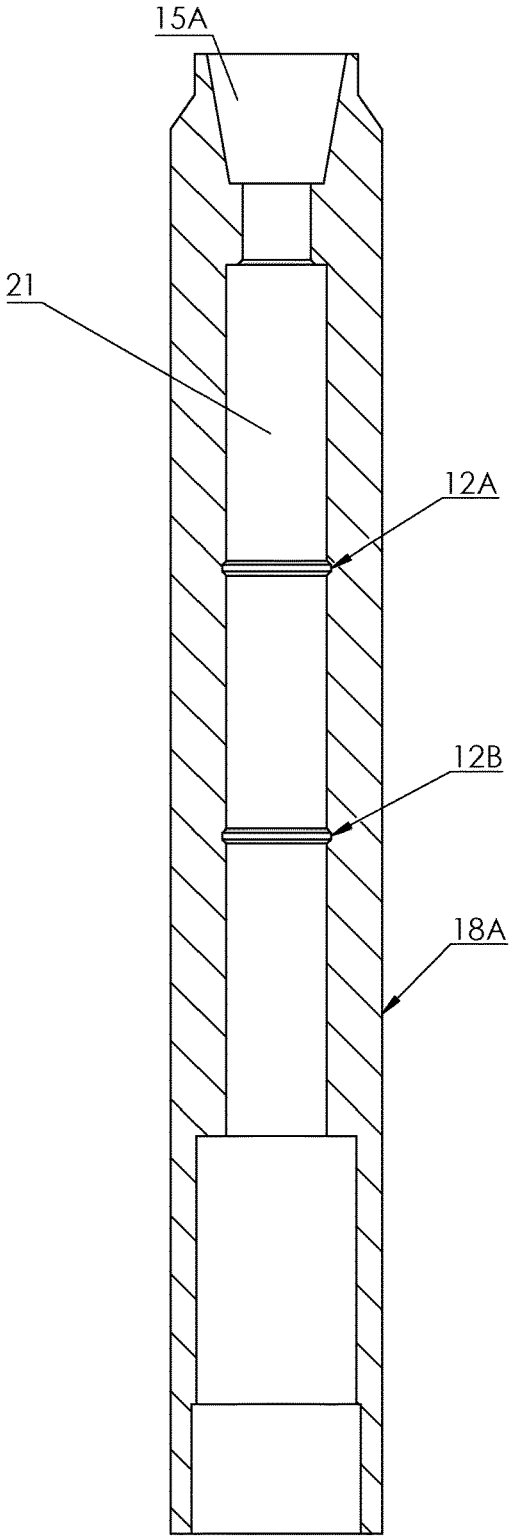
FIG. 4 shows a cross section of the upper housing.

Present also at least in part within the sub 18 is a sliding sleeve 2 that can translate therein. The sliding sleeve in the preferred form has an outer diameter substantially the same as the main interior diameter of the hollow interior 21. This has the functionality that when moved into place, as shown in FIG. 1B it will hold the flap valve open. The sliding sleeve is preferably frictionally engaged with the sub 18 such that under nor mal flow operations of the drill string and fluids and objects passing through the sub 18 and sliding sleeve 2 the sliding sleeve 2 will remain in whatever location it is actuated to, for example clear of the flap valve 5 in FIG. 1A or retaining the flap valve 5 open, as in FIG. 1B. The frictional engagement in the preferred forms can be supplied by a collet 11 as shown in FIG. 2 on the sliding sleeve 2 at a convenient location or locations, for example at an upper end as shown in FIG. 2. "O" rings 14 are also present to perform a wiping and or sealing function to ensure grit and debris is wiped clear on actuation and can seal any cavities off as desired, for example between the outer wall of the sliding sleeve and the hollow interior 21. In other forms the frictional engagement is aided by an elastomeric element.

In one embodiment as shown in FIG. 2, the sliding sleeve 2 is a multipart assembly and consists of a spring collet 11 shown in detail FIG. 2. This engages in upper and lower detent grooves 12A and 12B respectively within the upper housing 18A when the sliding sleeve 2 is in either the clear or first position as shown in FIG. 1A or retaining open or second position respectively as shown in FIG. 1B. The collet and friction prevents the sleeve 2 from moving for reasons such as vibrations in the drill string or forces generated by fluid flowing through the sleeve 2. Wiper O-rings 14 also prevent ingress of material into the spring collet mechanism 9.

At or toward each end 23 of the sliding sleeve is a tool engaging profile 24, preferably in the interior surface as shown in FIG. 2. Each profile 24A is arranged to engage with a tool 7 when the tool 7 is travelling in the correct direction and in the correct orientation and allow the tool 7 to actuate the sliding sleeve 2 and translate it between the first position or second position, or vice versa.

The float valve 1 may be actuated by many different methods such as a tool 7 conveyed on wireline or slick line 8, dropped or pumped down the drill string 3, tractor systems, mud pulse systems or other ways of communicating tools and objects down hole, that is down the drill string 3.

In the float valve open position shown in FIG. 1B the float valve gate 3 is held so that it is not an obstruction to objects being conveyed through the float valve.

One such a sliding sleeve 2 shown in FIGS. 1, 2, 3 and 4 is actuated by a particular tool 7 referred to as a 'B shifting tool', commonly conveyed on wireline (not shown). Alternatively this design could also be actuated using a B shifting tool that is dropped, pumped or conveyed by other means along the drill string.

The method of moving the sliding sleeve 2 into the float valve 1 will now be described with reference to FIGS. 6A and 6B.

The B shifting tool 7 has keys 10 on external surfaces thereof as shown in FIG. 6. These keys 10 have an angled leading edge 25 and a step shaped trailing edge 26. The keys 10 are biased outwardly. The tools 7 are brought down to the float valve 1 and its sliding sleeve 2.

Figure 6A:
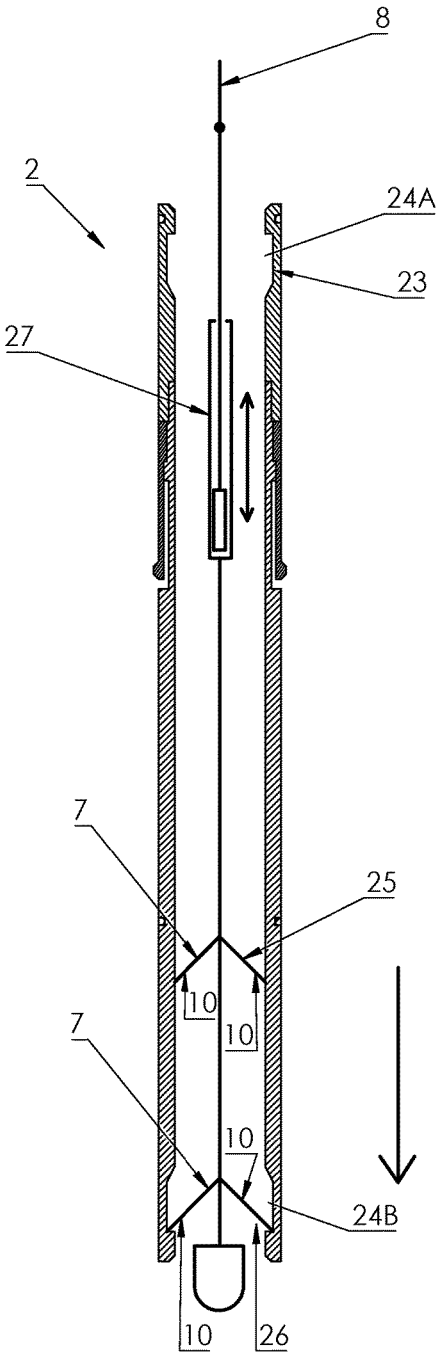
FIG. 6A shows a cross section from FIG. 2 showing tools engaged to actuate the sliding sleeve from the first position, clear of the valve (not shown) to second position retaining the valve open.

Looking at FIG. 6A the tools 7 are lowered by a slickline 8 through the sliding sleeve 2 and tools 7 don't engage the upper tool engaging profile 24A because of their orientation, but are allowed to slide past it. They then slide down through the sliding sleeve until the trailing edge 26 of the lower most tool 7 is engaged with the tool engaging profile 24B—in this case the trailing edge 26 and profile 24B have a complimentary step shape which the biasing out of the keys on the tool 7 engages with. When engaged in the tool engaging profile 24B on the sliding sleeve 2 a force is applied to the sliding sleeve 2 via the B shifting tool in order to move the sliding sleeve 2 downward and actuate it from the first position (as shown in FIG. 1A) and push against the flapper valve 5 and open the float valve gate 5 (i.e. the valve member or flapper) and the sliding sleeve moves through, pushing the flapper valve 5 aside as it moves to the second position, retaining the flapper valve 5 open, as shown in FIG. 1B. The force can be applied in known ways for down hole operations. In the embodiment shown the force to actuate the sliding sleeve 2 is provided by a spang jars 27 actuated by slickline 8 (i.e. raised a certain distance and then allowed to fall down). In other methods this is achieved for example by tractor driving, gravity, or by fluid pushing.

Once the sliding sleeve 2 has moved to its lower or second position (shown in FIG. 1B), the leading edge (not shown) on the B shifting tool contacts a lower interior profile 28A of the lower sub 18B which releases the keys 10 from the tool engaging profile 24B by forcing the keys inwardly to release from the profile. The B shifting tool then passes through the float valve 2 assembly and may proceed further along the drill string, for example to another float valve in the drill string.

When moving from the first position to the second position, in the preferred embodiment, there are two (or more) shifting tools 7 one after each other in the same orientation as shown in FIG. 6A. Therefore if the first tool 7 should actuate or fail for some reason, the second tool (and subsequent tools if present) is/are there to back it up. This prevents the shifting tool from passing through the sleeve before it has fully travelled, and hence prevents the tool/slickline from getting stuck in the flapper valve.

This method is repeated sequentially down the drill string until the desired number of float valves have been opened.

Once the valves are open to the desired lower level the tool 7 preferably is withdrawn and then down hole operations can be done, for example surveying, pipe recovery operations or similar. In some operations the operations tooling may be present after the shifting tools on the slick line 8 to save having to withdraw the line with the shifting tools and then reset the line with the operations tools.

The method of removing the sliding sleeve 2 from the float valve 2 from second position where it retains the flap valve 5 open to the first position where it is clear will now be described with reference to FIG. 6B. The upper B shifting tool's orientation is reversed so that the keys 10 in the upper tool 7A will engage on the sliding sleeve's 2 other tool engaging profile 24A—notice 24A is the same profile as 24B but reversed. In the preferred form there are two b shifting tools 7A and 7B and the lower most one's 7B orientation is not reversed. In this way the tool assembly will be prevented from falling through the valve should partial actuation of the sleeve occur as the lower most tool will catch on its lower most tool engaging profile 24B as described above. A force is applied to the sleeve 2 via the B shifting tool 7A in order to move the sleeve 2 upward to release valve 5 and return the float valve to its normal mode of operation, for example closed. Once the sliding sleeve 2 has been shifted or actuated to its upper or first position, keys on the B shifting tool contact the upper interior profile 28B (see FIG. 1B) of the upper sub 18A and release the B shifting tool 7A from the sliding sleeve 2. The B shifting tool then passes through the float valve assembly and may proceed further along the drill string sequentially shifting further valves up the string to the first position. The force to actuate can be supplied by pulling on the wire line or slick line 8, or by jarring, or by tractoring depending on the tool method used.

Figure 6B:
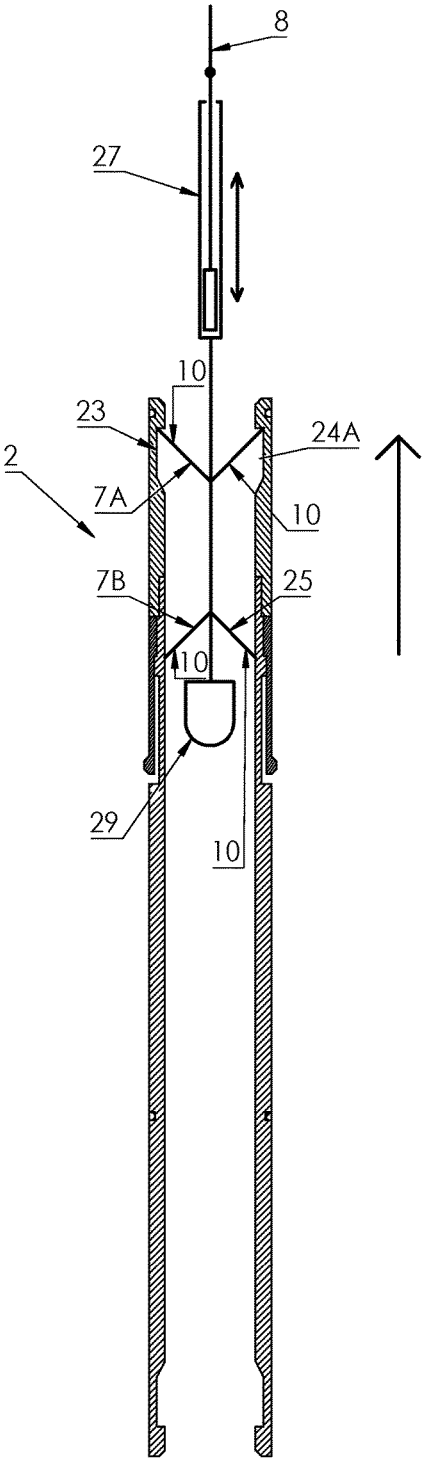
FIG. 6B shows a similar view to FIG. 6A, but showing tool reversed and engaged to shift sliding sleeve from the second position to the first position.

Similar to above, when shifting the sleeve 2 from the first position clear of the flap valve 5 to the second position when it is retaining the flap valve 5 open there is a risk when shifting the sleeve 2, the other way, back to the first position to be clear of the flap valve 5, as shown in FIG. 6B.

This can occur when the slick line tool 7 is down the hole and the sleeve 2 is moved up to or toward the first position and the flap valve 5 can now close. In this situation, if the tool 7 passes below the flap valve 5 for some reason, then the tooling 7 will be stuck below the flap valve—effectively the flap valve 5 will try and close under biasing, and occlude the hollow interior 21 as it is designed to do. The tool 7 is now stuck below the flap valve and cannot be lifted back up on the slickline.

This can occur if the B shifting tool keys disengage from the upper profile during slick line jarring and allow the B shifting tool to pass or fall down through the now free to close float valve.

To reduce the risk of this happening it is possible to use multiple B shifting tools 7 in series with the lower most one 7B being reversed in orientation to the upper one(s) 7A. In this way the tool assembly will be prevented from falling through the valve as the lower most tool will catch on its lower most tool engaging profile 24B as described above. In the event the sliding sleeve 2 fails to move from the second position to the first position it may be necessary to withdraw the B shifting tool from the device. The B-shifting tool has a safety shear pin that allows the keys to collapse should excessive force be applied during shifting.

A bottom bull nose 29 on the B shifting tool with no protruding edges will ensure the float valve gate does not catch on the bottom of the shifting tool when it is protruding from the lower end of the sleeve.

Below is a sequence of events for use of the float valve invention from a test scenario. In this case only one float valve down the drill string was used, but two or more could easily have been actuated. In actual operation some steps are omitted as they are irrelevant.

Sub assembly installation in drill string:

- Float valve assembly (sub 18 loaded with sliding sleeve 2 installed, then valve body 22 with flap valve 5) installed in drill string. 5R GS float valve with flapper was used. Sleeve in upper or first position (Float valve operational).
- Drill string run into well. Expected float valve depth 1375 m.

Opening valve on slickline:

- Slickline tool string assembled with two B-shifting tools with keys orientated to shift sleeve 2 down. No shear rings' installed in shifting tools 7.
- RIH (Run In Hole) slickline and tagged sleeve at 1377 m (drop in tension)
- Jarred down 6 times, tension regained and run through float valve assembly.
- Conveyed up and down through valve assembly 3 times.
- Run in hole to 1398 m
- POOH Closing valve on slickline:

- Slickline tool string assembled with two B-shifting tools. Lower shifting tool with keys orientated down (to prevent fall through), 'no shear ring' installed. Upper shifting tool with keys orientated to shift sleeve up, safety shear pin installed.
- RIH. Pick up weight at 1360 m of 400 lb
- Run in hole through valve assembly to 1395 m
- Pull up to sleeve. Pulled 600 lb at 1377 m
- Jarred up 11 times, tension dropped and tool string pulled up through sleeve.
- RIH and lightly tagged lower profile of sleeve then pulled back up through sleeve.
- POOH
- Inspected shifting tool safety shear pin and confirmed pin intact.
- Slickline rigged down.

Assembly inspection:

- POOH drill string. Wireline float valve sub removed from drill string.
- Sleeve observed to be in upper position with float valve operational.
- System functioned at surface successfully.
- System disassembled—no damage to assembly.

Test Results

The wireline float valve 1 system was positioned at 1377 m in hole 4. Slickline tools 7 successfully shifted the sleeve 2 into the flap valve 5. Slickline tools 7 were conveyed through the float valve 1. The sleeve 2 was then successfully shifted to its upper or first position (see FIG. 1A) clear of the flap valve 5 allowing normal float valve operation.

The present invention provides a float valve 1 in cross section that provides a large flow area for drill fluid which can be sequentially opened and held open down a drill string 3 to a desired lower level and then sequentially closed back up the drill string 3 to a desired upper level which is the location of the upper most float valve 1.

Once in the float valve open position there are minimal obtrusions in the drill string that could hinder movement of objects through the float valve. This device has the ability to hold open all float valves in the drill string with one run in hole of the actuating tool. It has minimal moving parts to wear and require servicing. It is easy to manufacture, assemble and maintain. It is robust to withstand harsh operating conditions.

The present invention has also at least the following benefits.

From the example in the introduction the present invention can save about NZ$1.8 million per year based on the figures in that example. This alone is a significant saving, but across a fleet or rigs, for a client, or even an industry the present invention can save significant money.

It is easier using the invention to recover pipe if stuck in hole. In the event that the drill string becomes stuck in hole the wireline float valve system allows immediate wireline access to the Bottom Hole Assembly (BHA) to assess stuck point and to run fishing equipment into the BHA. This can eliminate days of recovery operations to remove float valves from the drill string and reduces the risks associated with mechanical back-offs and multiple string shot explosive back-offs. A fast and controlled pipe recovery procedure is expected to increase the chance of recovering valuable BHA and drill string components.

Due to the many variables in these situations, it is difficult to estimate the savings generated. For example if a rig were to get stuck twice a year, and each time 5 days of rig time is saved this equates to $1 M/year in rig time alone.

A reduction in wear of the drill string threads: drill string component make and breaks are greatly reduced due to eliminating the need to trip for surveys. For example, if we assume that a bit trip is made every 700 m of drilling, other than the initial trip in hole and the final trip out of hole, only one additional trip out of hole will be made at 2200 m. An independent inspection service has informed that drill pipe threads are inspected every 2nd well and approximately 10% of the threads require redress. Cost for a thread redress is $450 each, therefore a significant saving can be made if the period between re-dressing is increased.

Reduced rig wear and tear: utilising the wireline float valve system reduces the need to trip and will reduce wear and tear on the rig and drilling equipment.

Reverse circulating: for various reasons reverse circulation of drilling fluids may be beneficial. The wireline float valve system can make this a possibility without tripping out of hole to remove float valves.

Safety: reduced handling of string floats, tripping distance and rig operations has health and safety benefits.

The foregoing description of the invention includes preferred forms thereof. Modifications may be made thereto without departing from the scope of the invention.

The invention claimed is:

1. A system including a drill string float valve and a tool, said drill string float valve adapted for positioning downhole within a wellbore as part of a drill string, said drill string float valve comprising:

an outer hollow housing for connection to and location between upper and lower sections of said drill string;

a flap valve located at least in part within said outer hollow housing to allow or disallow flow of fluid and/or objects through said outer hollow housing via said drill string float valve; and a sliding sleeve at least in part within said outer hollow housing, to translate at least in part within said outer hollow housing between at least a first position and a second position, said sliding sleeve comprising an outer surface and an inner surface extending between an upper end and a lower end, wherein when in said first position, said sliding sleeve is clear of said flap valve and said flap valve is closed, disallowing flow of fluid and/or objects, and when in said second position, said outside surface of said sliding sleeve is adjacent said flap valve blocking closure of said flap valve and retaining said flap valve open allowing flow of fluid and/or objects, wherein as said sliding sleeve moves from said first position towards said second position, said lower end contacts said flap valve and pushes said flap valve aside;

wherein said sliding sleeve has a plurality of tool engaging profiles for engaging with said tool, said plurality of tool engaging profiles comprising at least one upper tool engaging profile defined in said inner surface of said sliding sleeve proximate said upper end and at least one lower tool engaging profile defined in said inner surface of said sliding sleeve proximate said lower end, wherein said sliding sleeve is remotely actuable by said tool to move said sliding sleeve between said first and second positions, said tool selectively engaging said at least one lower tool engaging profile to move said sliding sleeve towards said second position and selectively engaging said at least one upper tool engaging profile to move said sliding sleeve towards said first position;

wherein said tool is able to expand and contract to engage and disengage with said plurality of tool engaging profiles.

2. A system as claimed in claim 1 wherein said plurality of tool engaging profiles are directionally specific so as to only engage with said tool at least when said tool is moving in the correct direction to engage therewith.

3. A system as claimed in claim 2 wherein said tool has an engaging orientation and a non-engaging orientation, and must be in said engaging orientation and travelling in said correct direction to engage with said plurality of tool engaging profiles and remotely actuate said sliding sleeve.

4. A system as claimed in 3 wherein said at least one upper tool engaging profile and said at least one lower tool engaging profile are oriented in the direction opposite to that of the other.

5. A system as claimed in claim 1 wherein said tool is a shifting tool and said shifting tool is dropped, pumped, tractored, run on slick line or wireline, or conveyed by other means along said drill string.

6. A system as claimed in claim 1 wherein there are least two tools, a first and a second said tool, each after the other, to achieve said remote actuation, said second and any subsequent tools present to back up said first tool.

7. A system as claimed in claim 6 wherein when moving said tool down said drill string to actuate said sliding sleeve to retain said flap valve open, said first tool, said second tool and any said subsequent tools are in the same engaging orientation and the second tool and any said subsequent tools will engage said sliding sleeve and shift it if said first tool fails to fully actuate said sleeve from said first position to said second position.

8. A system as claimed in claim 1 wherein said tool is moved down from an upper level to a desired lower level of said drill string to actuate sequentially a series of said sliding sleeves from said first position into said second position down said drill string to said desired lower level.

9. A system as claimed in claim 1 wherein when moving said tool up said drill string to actuate said sliding sleeve to said first position clear of said flap valve to allow to close, a second tool is in an engaging orientation to actuate said sliding sleeve to said first position and a first tool is in the opposite orientation such that it cannot fall past said flap valve once said sliding sleeve is clear of said flap valve.

10. A system as claimed in claim 8 wherein said tool is moved up from at or toward said desired lower level of said drill string to actuate sequentially a series of said sliding sleeves from said second position into said first position up said drill string.

11. A system as claimed in claim 1 wherein said sliding sleeve has at least one locking portion that engages with an interior of said outer hollow housing to provide a friction against movement of said sliding sleeve.

12. A system as claimed in claim 11 wherein said at least one locking portion is provided by any one or more of:

a. at least one elastomeric material; or b. a locking collet means.

13. A system as claimed in claim 11 wherein said interior has detents to selectively receive said at least one locking portion to prevent movement of said sliding sleeve save for when actuated.

14. A system including a drill string with a drill string float valve and a tool, said drill string float valve comprising:

at least one sub for location between lengths of the drill string, an upper portion in selective fluid communication with a lower portion via a hollow interior thereof;

a flap valve located at least in part within said at least one sub to allow or disallow flow of fluid and/or objects through said hollow interior via said drill string float valve; and a sliding sleeve at least in part within said at least one sub, to translate at least in part within said at least one sub between at least a first position and a second position, said sliding sleeve comprising an outer surface and an inner surface extending between an upper end and a lower end, wherein when in said first position, said sliding sleeve is clear of said flap valve and said flap valve is closed, disallowing flow of fluid and/or objects, and when in said second position, said outside surface of said sliding sleeve is adjacent said flap valve blocking closure of said flap valve and retaining said flap valve open allowing flow of fluid and/or objects, wherein as said sliding sleeve moves from said first position towards said second position, said lower end contacts said flap valve and pushes said flap valve aside;

wherein said sliding sleeve has a plurality of tool engaging profiles for engaging with said tool, said plurality of tool engaging profiles comprising at least one upper tool engaging profile defined in said inner surface of said sliding sleeve proximate said upper end and at least one lower tool engaging profile defined in said inner surface of said sliding sleeve proximate said lower end, wherein said sliding sleeve is remotely actuable by said tool to move said sliding sleeve between said first and second positions, said tool selectively engaging said at least one lower tool engaging profile to move said sliding sleeve towards said second position and selectively engaging said at least one upper tool engaging profile to move said sliding sleeve towards said first position; and wherein said tool is able to expand and contract to engage and disengage with said plurality of tool engaging profiles.

15. A system as claimed in claim 14 wherein there is a plurality of said drill string float valves in said drill string.

16. A system as claimed in claim 15 wherein said tool is a shifting tool that is dropped, pumped or conveyed by wireline or slickline other means along said drill string.

17. A system as claimed in claim 16 wherein said plurality of drill string float valves can be sequentially opened from above down to a desired lower level, by said shifting tool shifting said sliding sleeves in each said drill string float valve to said second position, and then sequentially closed from below from at or near said desired lower level by shifting said sliding sleeves in each said drill string float valves to said first position.

18. A kit of parts for a drill string float valve comprising:

at least one sub;

a flap valve for location within the at least one sub, said flap valve able to open and allow movement through said at least one sub, or close to seal and prevent movement through said at least one sub;

a sliding sleeve for location within said at least one sub and comprising an outer surface and an inner surface extending between an upper end and a lower end, said sliding sleeve, when assembled, is configured to slide relative to said at least one sub between a first position where said sliding sleeve is clear of said flap valve allowing said flap valve to close, and a second position where said outside surface of said sliding sleeve is adjacent said flap valve and retaining said flap valve open to allow said movement therethrough, wherein as said sliding sleeve moves from said first position towards said second position, said lower end contacts said flap valve and pushes said flap valve aside; and a tool;

wherein said sliding sleeve has a plurality of tool engaging profiles for engaging with said tool, said plurality of tool engaging profiles comprising at least one upper tool engaging profile defined in said inner surface of said sliding sleeve proximate said upper end and at least one lower tool engaging profile defined in said inner surface of said sliding sleeve proximate said lower end, wherein when said drill string float valve is assembled as part of a drill string, said sliding sleeve is remotely actuable by said tool to move said sliding sleeve between said first and second positions, said tool selectively engaging said at least one lower tool engaging profile to move said sliding sleeve towards said second position and selectively engaging said at least one upper tool engaging profile to move said sliding sleeve towards said first position; and wherein said tool is able to expand and contract to engage and disengage with said plurality of tool engaging profiles.

19. A kit as claimed in claim 18 wherein said at least one sub can be disassembled into an upper portion and a lower portion to access a hollow of said at least one sub to allow assembly and disassembly of said flap valve and said sliding sleeve within said hollow.

* * * * *